US006666297B2

(12) United States Patent
Grosser et al.

(10) Patent No.: US 6,666,297 B2
(45) Date of Patent: Dec. 23, 2003

(54) ACOUSTIC SHIELDING ARTICLE

(75) Inventors: Ulrich Grosser, Kürten (DE); Jürgen Knaup, Köln (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/342,583

(22) Filed: Jan. 15, 2003

(65) Prior Publication Data

US 2003/0136606 A1 Jul. 24, 2003

(30) Foreign Application Priority Data

Jan. 18, 2002 (DE) ..... 102 01 763

(51) Int. Cl.[7] ..... E04B 1/82

(52) U.S. Cl. ..... 181/204; 181/286; 123/195 C; 123/90.37

(58) Field of Search ..... 181/204, 205, 181/200, 198, 294, 290, 291, 286, 210; 123/195 C, 198 E, 90.37, 90.38; 428/444

(56) References Cited

U.S. PATENT DOCUMENTS

| | | | | | |
|---|---|---|---|---|---|
| 3,773,605 | A | * | 11/1973 | Pihlstrom | 181/294 |
| 3,867,240 | A | * | 2/1975 | Doerfling | 181/291 |
| 4,048,366 | A | * | 9/1977 | Kingsbury | 181/204 |
| 4,522,165 | A | * | 6/1985 | Ogawa | 181/204 |
| 4,615,411 | A | * | 10/1986 | Breitscheidel et al. | 181/224 |
| 4,619,344 | A | * | 10/1986 | Uesugi et al. | 181/229 |
| 4,655,496 | A | * | 4/1987 | Gahlau et al. | 181/204 |
| 4,942,907 | A | * | 7/1990 | Joh et al. | 181/207 |
| 5,190,803 | A | | 3/1993 | Goldbach et al. | 428/138 |
| 5,298,694 | A | * | 3/1994 | Thompson et al. | 181/286 |
| 5,681,072 | A | * | 10/1997 | Stricker | 181/205 |
| 5,842,265 | A | | 12/1998 | Rink | 29/460 |
| 5,940,949 | A | | 8/1999 | Rink | 29/33 K |
| 5,971,099 | A | * | 10/1999 | Yasuda et al. | 181/286 |
| 6,376,396 | B1 | * | 4/2002 | Thorn et al. | 181/290 |
| 6,398,259 | B1 | | 6/2002 | Palmer et al. | 280/777 |

FOREIGN PATENT DOCUMENTS

| | | | | |
|---|---|---|---|---|
| DE | 4233449 A1 | * | 4/1993 | B32B/5/26 |
| DE | 200 02 683 | | 6/2000 | |
| EP | 0 063 715 | | 11/1982 | |
| EP | 0 310 118 | | 4/1989 | |
| GB | 2 106 612 | | 4/1983 | |
| JP | 01211610 A | * | 8/1989 | F01N/7/16 |

* cited by examiner

*Primary Examiner*—Kimberly Lockett
*Assistant Examiner*—Eduardo Colon-Santana
(74) *Attorney, Agent, or Firm*—Joseph C. Gil; James R. Franks

(57) ABSTRACT

An acoustic shielding article which includes a shaped thermoplastic element that has a metal inlay element fixedly attached thereto, is described. More particularly, the acoustic shielding article (1) includes: (a) a shaped thermoplastic element (3) having a surface (11) that faces a source of sound (14); and (b) a metal inlay element (2) having substantially opposed first (17) and second (20) surfaces, at least one of which is fixedly joined to the shaped thermoplastic element. The shaped thermoplastic element is formed by means of molding thermoplastic material onto at least one of the first and second surfaces of the metal inlay element, thereby fixedly joining the metal inlay element to the shaped thermoplastic element. In an embodiment of the present invention, the metal inlay element has a plurality of perforations having edges, and a portion of the thermoplastic material of the shaped thermoplastic element extends through and embeds the edges of at least some of the perforations, thereby fixedly attaching the metal inlay element to the shaped thermoplastic element. The acoustic shielding article of the present invention may be used as an air intake pipe of an internal combustion engine, e.g., of a motor vehicle.

14 Claims, 3 Drawing Sheets

ACOUSTIC SHIELDING ARTICLE

CROSS REFERENCE TO RELATED PATENT APPLICATION

The present patent application claims the right of priority under 35U.S.C. §119 (a)–(d) of German Patent Application No. 102 01 763.8, filed Jan. 18, 2002.

FIELD OF THE INVENTION

The invention relates to an acoustic shielding article for the shielding of sound sources, which may be used, for example, in conjunction with motor vehicle engines. The acoustic shielding article includes a shaped thermoplastic element and a metal inlay element, e.g., a metal sheet, that is fixedly joined to the shaped thermoplastic element by means of injection molding. The shaped thermoplastic element has a surface that faces the source of sound.

BACKGROUND OF THE INVENTION

Acoustic requirements in respect of machines, such as vehicles, e.g., in a motor vehicle engine compartment, typically require sound insulation (or abatement) measures. Intake manifolds of, for example, motor vehicle engines, are sound emitters, especially in the area of the collectors. The acoustic power arising from, for example, an intake manifold, derives (i) on the one hand from deformations of the outer wall (vibrations, natural resonances)/structure-borne sound, and (ii) on the other hand from internal noises (passage of sound through the outer wall)/airborne noise of the intake manifold. It is typically necessary to absorb or deaden these noises to achieve adequate levels of noise or sound abatement. Acoustic covers are typically used, for example, in motor vehicles to insulate the sound emissions of the engine and equipment, to influence the noise radiation of the motor vehicle positively (i.e., to reduce sound emissions). To achieve an adequate level of sound abatement in an optimum manner, components having the following characteristics are generally required: rigidity, dimensional stability, high weight per unit area, accuracy of fit and high self-dampening.

Components of this type can then be used as housing components of noise emitters (e.g., intake manifolds of motor vehicle engines) and/or as acoustic covers (e.g., acoustic covers in the motor vehicle engine compartments).

At present, thick-walled metal components, such as intake manifolds, are sometimes used in those applications where sound or noise is generated. Closed-cell foams may be applied to plastic components as dampers. Plastic parts may be ribbed to increase rigidity. Additional covers, optionally with an additional insulating layer (e.g., integral foam or bitumen-based insulating mats) may be employed. So-called insulating mats may be glued on a component surface to increase the specific weight per unit area of the component wall.

Furthermore, so-called "kissing (or contact) points" may be provided (e.g., on intake manifolds) to stiffen vibrating walls by supporting them against one another. Disadvantages of the contact point technique include disturbances in the inner volume of the component, a reduction in the flow cross-section and an increased construction space. The wall thicknesses of plastic components are normally increased to increase the weight per unit area and the stiffness of the component. The disadvantages of increasing wall thicknesses include a more demanding and expensive material use of plastic. The approach of increasing wall thicknesses is also ineffective due to the comparatively small modulus of elasticity of plastic. Ribs may optionally be mounted on the component wall, but this approach is typically subject to the accompanying disadvantages as described above.

SUMMARY OF THE INVENTION

The object of the invention is to provide an acoustic shielding article for the shielding of sound sources, in particular on motor vehicle engines, that avoids the disadvantages of the known constructions and offers comparatively good acoustic shielding.

In accordance with the present invention, there is provided an acoustic shielding article (1) comprising:

(a) a shaped thermoplastic element (3), said shaped thermoplastic element having a surface (11) that faces a source of sound (14); and (b) an inlay element (2) having substantially opposed first (17) and second (20) surfaces (e.g., having a two-dimensional shape, such as that of a sheet), at least one of said first (17) and second (20) surfaces of said inlay element (2) being fixedly joined to said shaped thermoplastic element (3), said inlay element (2) being fabricated from metal, wherein said shaped thermoplastic element (3) is formed by means of molding thermoplastic material onto at least one of said first (17) and second (20) surfaces of said inlay element (2), thereby fixedly joining said inlay element (2) to said shaped thermoplastic element (3).

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

Unless otherwise indicated, all numbers or expressions, such as those expressing structural dimensions, quantities of ingredients, etc. used in the specification and claims are understood as modified in all instances by the term "about."

BRIEF DESCRIPTION OF THE DRAWING FIGURES

Figure 1:
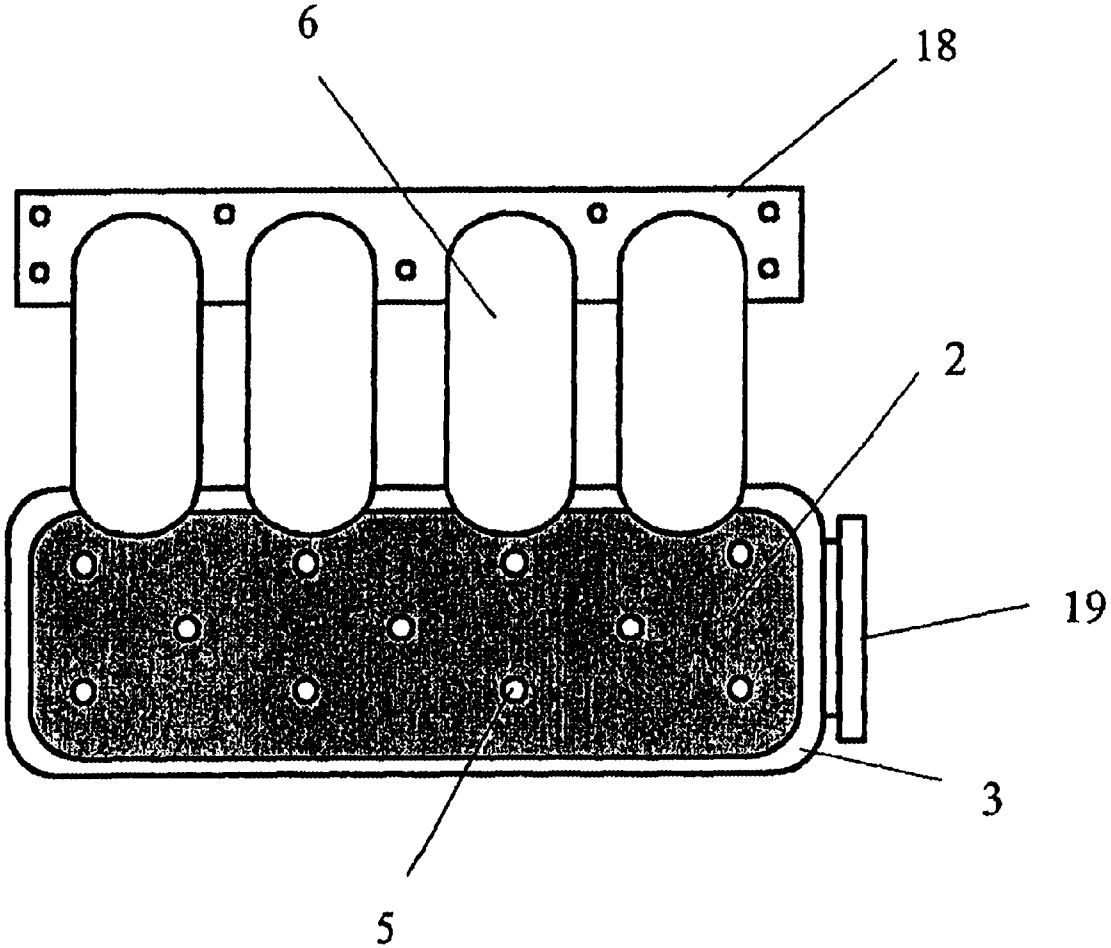
FIG. 1 is a representative schematic view of an air collector (6) having an intake pipe (1) with sheet metal reinforcement (2)
Figure 2:
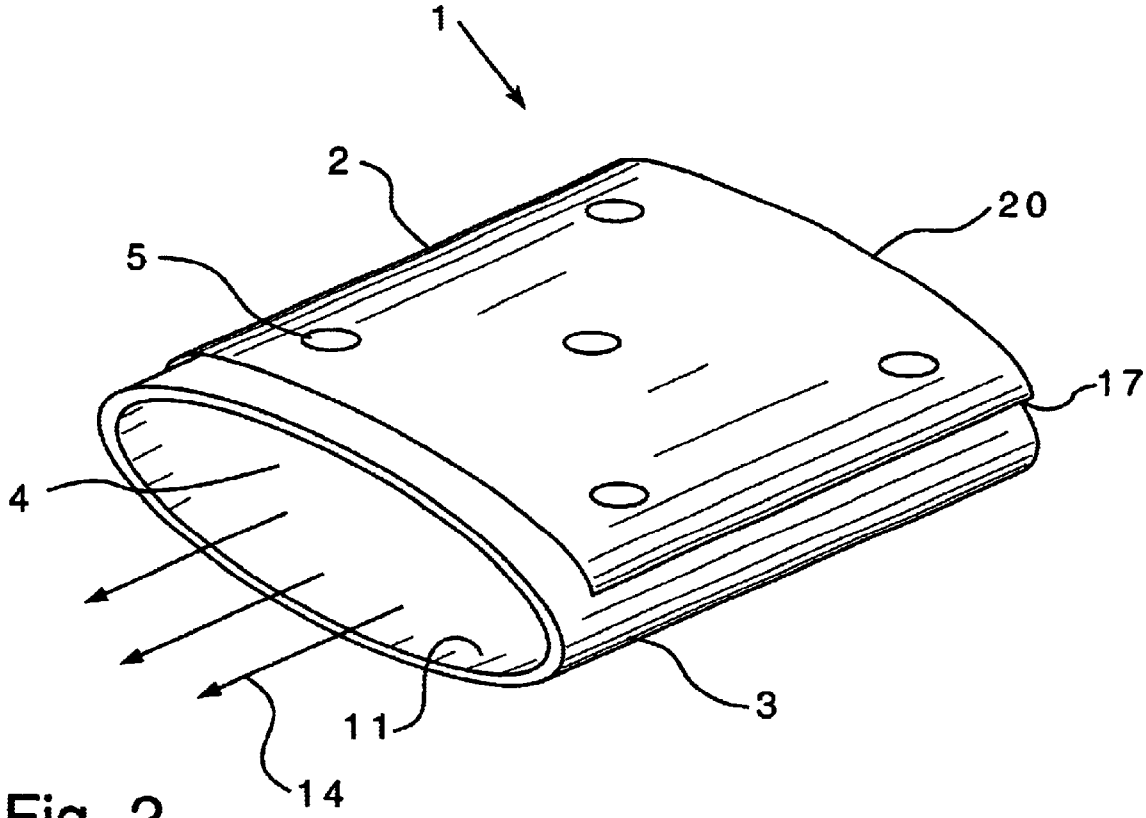
FIG. 2 is a perspective sectional view of a tubular acoustic shielding article according to the present invention, in the form of an intake pipe, having a sheet metal inlay element (2)

In FIGS. 1 and 2, like reference numerals designate the same components and structural features.

DETAILED DESCRIPTION OF THE INVENTION

In an embodiment of the present invention, the acoustic shielding article is in the form of a tube (or pipe) through which gas flows (indicated by arrows 14 in FIG. 2). The tubular acoustic shielding article has an inner (or interior) surface that is defined by the surface (11) of the shaped thermoplastic element (a) that faces the source of sound (14). The inner surface (11) of the tubular acoustic shielding article further defines an interior chamber or passage (4) through which the gas (14) flows. In a further embodiment of the present invention, the tubular acoustic shielding article is an air intake pipe for a combustion engine (e.g., of a motor vehicle).

In another embodiment of the present invention, the acoustic shielding article is an air filter casing for combustion engines (e.g., of motor vehicles).

In yet a further embodiment of the present invention, the acoustic shielding article is an engine cover for combustion engines (e.g., of motor vehicles).

The metal inlay element of the acoustic shielding article may be fixedly joined (or attached) to the shaped thermoplastic element by means of an adhesive interaction between the two elements (e.g., when the thermoplastic material of the shaped thermoplastic element is injection molded against only one of the first or second surfaces of the metal inlay element). Alternatively, or in addition to an adhesive interaction, the thermoplastic material of the shaped thermoplastic element may at least partially envelope the metal inlay element (e.g., when the thermoplastic material of the shaped thermoplastic element is injection molded against only the first surface and at least a portion of the second surface of the metal inlay element).

In a preferred embodiment of the present invention, the inlay element (which may be in the form of a metal sheet) has a plurality of: knubs; indentations; recesses; perforations having edges; or a combination of at least two of such features (e.g., knubs and perforations having edges). The shaped thermoplastic element is formed by means of injection molding thermoplastic material onto at least one of the first and second surfaces of the inlay element, a portion of the thermoplastic material of the shaped thermoplastic element: (i) embeds the knubs; (ii) fills the indentations; (iii) fills the recesses; (iv) extends through at least some of the perforations, such that the edges of the perforations are embedded in the thermoplastic material extending therethrough; and (v) a combination of at least two of (i), (ii), (iii) and (iv). The interaction (e.g., embedding and/or filling) between the thermoplastic material of the shaped thermoplastic element and the inlay element serves to fixedly join (or attach) the inlay element to the shaped thermoplastic element, and to provide the acoustic shielding article with a desirably high degree of dimensional stability.

In a particularly preferred embodiment of the present invention, the inlay element has a plurality of perforations having edges, and the shaped thermoplastic element is formed by means of injection molding thermoplastic material onto at least one of the first and second surfaces of the inlay element. In the course of the injection molding operation, a portion of the thermoplastic material of the shaped thermoplastic element extends through at least some of the perforations of the inlay element. The edges of the perforations become embedded in the thermoplastic material extending therethrough, thereby fixedly joining (or attaching) the inlay element to the shaped thermoplastic element.

The injection molding means by which the metal inlay element may be fixedly attached to the shaped thermoplastic element of the acoustic shielding article, which has summarized above, is described in further detail in U.S. Pat. No. 5,190,803, the disclosure of which is incorporated herein in its entirety by reference.

The inlay element may be a wire mesh (e.g., a wire screen having a plurality of perforations or holes therein), in a further embodiment of the present invention. The shaped thermoplastic element may be formed by means of injection molding (or extrusion-coating) thermoplastic material onto at least one of (preferably both of) the first and second surfaces of the inlay element, thereby fixedly joining the inlay element to the shaped thermoplastic element. As used herein and in the claims the terms "first and second surfaces" as applied to a wire mesh inlay element, are meant to refer more particularly to the first and second sides of the wire mesh inlay element.

The metal inlay element of the acoustic shielding article may be present as a single unitary-structure (e.g., a unitary metal sheet) or as a plurality of separate structures (e.g., a plurality of metal sheets and/or wire mesh screens). The positioning of the metal inlay element within and/or on the shaped thermoplastic element is selected to provide an acoustic shielding article according to the present invention that has desirable properties selected from, for example, increased weight per unit area, increased rigidity, increased dampening characteristics and combinations thereof. The thermoplastic material of the shaped thermoplastic element is molded (e.g., injection molded, extrusion coated and/or sprayed) on the first and/or second surfaces of the metal inlay element.

An acoustic shielding article having a desirably high weight per unit area results, in particular, when the inlay element is fabricated from high density metal, which further enhances the absorption of airborne noise. The passage of sound through the wall(s) of the acoustic shielding article is thus greatly minimized.

An acoustic shielding article having a desirably high level of rigidity is achieved as a result of the combination of metal and plastic, which thereby minimizes the occurrence of structure-borne sound amplification, due to, for example, natural resonances of the acoustic shielding article.

The high dampening properties of the thermoplastic material of the shaped thermoplastic element which forms the walls of the acoustic shielding article provides good dampening of structure-borne and airborne sound. A high weight per unit area and high level of rigidity, due to the metal inlay of the acoustic shielding article, serves to both absorb the airborne sound and minimize the occurrence of structure-borne sound amplification. An acoustic shielding article according to the present invention, e.g. an acoustic cover of a motor vehicle engine, is strengthened by the presence of the metal inlay element, e.g., a preformed metal sheet, in that the metal inlay element is joined integrally and/or homogeneously to the thermoplastic of the shaped thermoplastic element. Joining is preferably achieved by means of art-recognized extrusion-coating technology, or injection molding, as described previously herein.

In addition to the molding of the thermoplastic material onto the first and/or second surfaces of the shaped thermoplastic element, the inlay element may optionally be further fixedly attached to the shaped thermoplastic element by means of screws, clips, riveting, flanging, gluing, art-recognized frictional connection means and/or art-recognized positive locking means (which are typically more expensive than the molding means of attachment). In multi-walled components, such as intake manifolds or air filter casings, the outer and/or upper walls of the multi-walled component are an acoustic shielding article according to the present invention.

Suitable plastics from which the shaped thermoplastic element may be fabricated include thermoplastic plastics and/or thermoplastic compositions. Classes of thermoplastic materials from which the shaped thermoplastic element may be fabricated include, for example, polyamides, polyalkylenes, polyesters, polycarbonates, graft copolymers and combinations thereof. Preferred thermoplastic materials from which the shaped thermoplastic element may be fabricated include, for example, polyamide 6 (PA 6), polyamide 6.6 (PA 6.6), polyamide 4.6 (PA 4.6), polpropylene (PP), polyethyleneterephthalate (PET), polybutyleneterephthalate (PBT), polycarbonate (PC, e.g., bisphenol-A based polycarbonates), acrylonitrile-butadiene-styrene graft copolymer (ABS) and combinations thereof (e.g., PC/ABS combinations).

The inlay element may be fabricated from a metal selected from, for example, steel, lead, aluminum, brass, copper and combinations or alloys thereof. Preferably, the inlay element is fabricated from steel and/or aluminum.

The present invention is more particularly described in the following examples, with reference to the drawing figures, which are intended to be illustrative only, since numerous modifications and variations therein will be apparent to those skilled in the art.

EXAMPLE

Comparative Example

The intake pipe of a 4-cylinder Otto engine is manufactured from polyamide 6 having 30 percent by weight of glass fibres and is equipped according to the prior art by means of the application of an integral foam (polyurethane) approx. 15 mm thick and with an additional acoustic hood approx. 3 mm thick, to meet the acoustic requirements in respect of sound insulation.

As an alternative, the upper shell of the air collector 6 was designed in accordance with the acoustic shielding article of the present invention, and as described in further detail with reference to FIGS. 1 and 2. A 1.5 mm thick steel sheet 2 was joined fixedly to the air collector 6 of glass-fibre-reinforced polyamide 6 by means of through-injected tie points in the form of sunken holes 5 during production in the injection-molding tool. A partially higher weight per unit area of the component wall and a higher rigidity of the component wall are hereby achieved. A sound source 4 consists here in the interior through which gas flows. Together with the plastic wall 3 of the component 6, the steel sheet 2 forms the acoustic shielding article 1 in relation to the sound source 4. A further sound source is the engine block, which is not shown in the figures and is joined to the outlet pipe (via the cylinder head flange 18). The throttle lodge flange 19 is connected to the throttle body (not shown).

The accumulated sound radiation, which results from structure-borne sound and the airborne sound source and is emitted by the component 6, which is constructed according to the invention, was calculated as described below in comparison with the arrangement according to different alternative variants according to the prior art. The design (1) of an air collector 6 has a wall thickness in the area of the sound source of 4.5 mm and is unribbed. The design (2) has a wall thickness of 4.5 mm in the area of the sound source 4 and is provided additionally with ribs of plastic. The design (3) has a wall thickness of 6 mm in the area of the sound source 4 and is unribbed. All designs (1, 2, 3) are fabricated from polyaminde.

Figure 3:
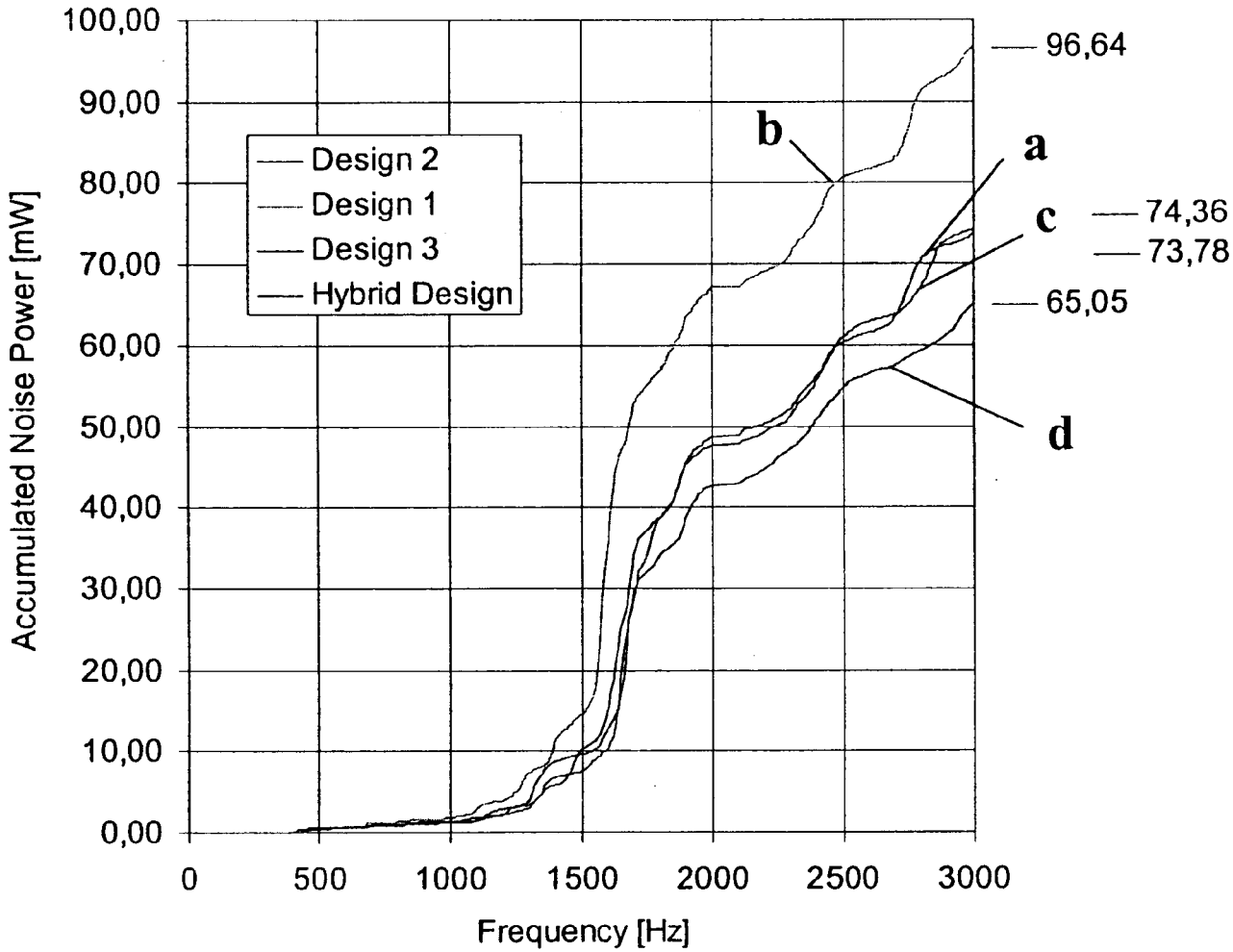
FIG. 3 is a graph showing a plot of accumulated noise power as a function of frequency for acoustic shielding articles of various design.

A calculation based on an Abaqus routine was carried out to optimize the single designs. This calculation shows as result the radiated noise power versus frequency. FIG. 3 shows the resulting curves form this calculation. Measurements carried out on later build Prototypes verified this results. The calculation shows the value of radiated noise energy caused by the structural borne and air borne noises inside the tested geometrie for the different designs.

The construction of the air collector 6 according tot he present invention, and described as hybrid design, has a wall thickness of 4 mm and additionally an inlaid metal sheet 2 according to FIGS. 1 and 2.

FIG. 3 shows the results achieved in the calculation. The accumulated acoustic power emitted is at its lowest in particular in the being thus demonstrated. A similar effect (as to sound/noise abatement) can only be achieved by significantly increasing the wall thicknesses of the comparative prior art designs, but turns out qualitatively poorer, i.e. a higher noise radiation was detected.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An acoustic shielding article comprising:

(a) a shaped thermoplastic element, said shaped thermoplastic element having a surface that faces a source of sound; and (b) an inlay element having substantially opposed first and second surfaces, at least one of said first and second surfaces of said inlay element being fixedly joined to said shaped thermoplastic element, said inlay element being fabricated from metal, wherein said shaped thermoplastic element is formed by means of injection molding thermoplastic material onto at least one of said first and second surfaces of said inlay element, a portion of the thermoplastic material of said shaped thermoplastic element extends through at least some of said perforations, the edges of said perforations being embedded in the thermoplastic material extending therethrough, thereby fixedly joining said inlay element to said shaped thermoplastic element.

2. The acoustic shielding article of claim 1 wherein said inlay element has a plurality of at least one of knubs, indentations and recesses, and when molding thermoplastic material onto at least one of said first and second surfaces of said inlay element, a portion of the thermoplastic material of said shaped thermoplastic element: (i) embeds said knubs; (ii) fills said indentations; (iii) fills said recesses; and (iv) a combination of at least two of (i), (ii) and (iii), thereby further fixedly joining said inlay element to said shaped thermoplastic element.

3. The acoustic shielding article of claim 2 wherein said inlay element is a metal sheet.

4. The acoustic shielding article of claim 1 wherein the thermoplastic material of said shaped thermoplastic element is selected from the group consisting of polyamides, polyalkylenes, polyesters, polycarbonates, graft copolymers and combinations thereof.

5. The acoustic shielding article of claim 4 wherein the thermoplastic material of said shaped thermoplastic element is selected from the group consisting of polyamide 6, polyamide 6.6, polyamide 4.6, polpropylene, polyethyleneterephthalate, polybutyleneterephthalate, polycarbonate, acrylonitrile-butadiene-styrene graft copolymer and combinations thereof.

6. The acoustic shielding article of claim 1 wherein said inlay element is fabricated from a metal selected from the group consisting of steel, lead, aluminum, brass, copper and combinations thereof.

7. The acoustic shielding article of claim 1 wherein said acoustic shielding article is in the form of a tube through which gas flows, the tubular acoustic shielding article having an inner surface, said inner surface being defined by said surface of said shaped thermoplastic element that faces said source of sound.

8. The acoustic shielding article of claim 7 wherein the tubular acoustic shielding article is an air intake pipe for a combustion engine.

9. The acoustic shielding article of claim 8 wherein said combustion engine is of a motor vehicle.

10. The acoustic shielding article of claim 1 wherein said acoustic shielding article is an air filter casing for a combustion engine.

11. The acoustic shielding article of claim 10 wherein said combustion engine is of a motor vehicle.

12. The acoustic shielding article of claim 1 wherein said acoustic shielding article is an engine cover for a combustion engine.

13. The acoustic shielding article of claim 12 wherein said combustion engine is of a motor vehicle.

14. The acoustic shielding article of claim 1 wherein said inlay element is a wire screen, and said shaped thermoplastic element is formed by means of molding thermoplastic material onto at least one of said first and second surfaces of said inlay element, thereby fixedly joining said inlay element to said shaped thermoplastic element.

* * * * *